US005451018A

United States Patent [19]

Heinze et al.

[11] Patent Number: 5,451,018

[45] Date of Patent: Sep. 19, 1995

[54] RAILWAY TONGUE AND RAIL JUNCTURE

[75] Inventors: Fridbert Heinze, Uelleben; Erich Nuding, Aalen; Friedhelm Wojtek, Hasbergen, all of Germany

[73] Assignee: BWG, Butzbacher Weichenbau GmbH, Germany

[21] Appl. No.: 171,477

[22] Filed: Dec. 23, 1993

[30] Foreign Application Priority Data

Dec. 24, 1992 [DE] Germany ..... 42 44 010.6

[51] Int. Cl.[6] ..... E01B 7/00

[52] U.S. Cl. ..... 246/442; 246/436; 246/437; 246/443

[58] Field of Search ..... 104/130 R, 130 AA, 130 F; 238/165; 246/415 R, 434, 442, 443, 438, 437, 436, 435 R

[56] References Cited

U.S. PATENT DOCUMENTS

| | | | |
|---|---|---|---|
| 580,071 | 4/1897 | Williams . | |
| 817,365 | 4/1906 | Davis et al. | 246/442 |
| 884,717 | 4/1908 | Cooke | 246/437 |
| 932,010 | 8/1909 | Fink | 246/442 |
| 1,000,233 | 8/1911 | Burress . | |
| 1,059,189 | 4/1913 | Melvin et al. . | |
| 1,301,099 | 4/1919 | Burton | 246/435 R |
| 1,848,363 | 3/1932 | Lee | 246/437 |
| 2,377,273 | 5/1945 | Siebert | 246/442 |
| 4,634,087 | 1/1987 | Kempa | 246/435 R |
| 5,303,884 | 4/1994 | Rivas | 246/437 |

FOREIGN PATENT DOCUMENTS

| | | | |
|---|---|---|---|
| 0111976 | 11/1940 | Australia | 238/165 |
| 144034 | 11/1984 | European Pat. Off. . | |
| 0302936 | 9/1916 | Germany | 238/165 |
| 0389364 | 7/1923 | Germany | 238/165 |
| 0449135 | 8/1927 | Germany | 246/435 R |
| 0466372 | 9/1928 | Germany | 246/435 R |
| 4214605 | 11/1993 | Germany | 246/442 |
| 0037179 | 4/1923 | Norway | 238/165 |
| 0030788 | 9/1909 | Sweden | 238/165 |
| 0120145 | 6/1926 | Switzerland | 246/435 R |
| 0233270 | 5/1925 | United Kingdom | 246/442 |

*Primary Examiner*—Mark T. Le

*Attorney, Agent, or Firm*—Dennison, Meserole, Pollack & Scheiner

[57] ABSTRACT

A railway tongue and junction rail assembly including a mounting fixed to the junction rail. The tongue abuts the junction rail at an inclined junction and is releasably secured within the mounting with the mounting being the sole means of joining the tongue to the junction rail.

11 Claims, 4 Drawing Sheets

RAILWAY TONGUE AND RAIL JUNCTURE

BACKGROUND OF THE INVENTION

The invention involves a switch tongue junction, which is unwelded and fits by means of an inclined junction into a junction rail.

Normally, the tongues of switches or junctions are welded into the junction rails with which they fit. This produces the disadvantage of causing considerable problems in manufacturing tongues made of such highly wear-resistant materials as manganese, since it is very difficult to weld these to junction rails or standard rails made of steel.

Welding of switch tongues and junction rails requires considerable installation time in order, for example, to replace worn or damaged tongues.

One tongue joint arrangement is known in which the tongue is held by a pivoted clip-type mounting.

A tongue of the type initially mentioned can be seen in EP 0 144 034 B1. In this case, the tongue and removable rail are screwed together by means of a distance fish plate. Various suggestions for connections to tramway rail sections can be seen in U.S. Pat. No. 1,000,233 and U.S. Pat. No. 1,059,189. In these cases screw connections or clips are used.

The problem underlying the present invention is to produce a switch tongue with the junction rail with which it fits of such a type that on the one hand any materials can be used for the tongue, without creating welding limitations, and, on the other hand, so that a simple replacement of tongues can take place without having the corresponding rail put out of operation for a lengthy period of time.

SUMMARY OF THE INVENTION

In the invention, this problem is essentially solved by having the tongue connected on a detachable basis to a mounting which is connected directly or indirectly on a permanent basis to the junction rail.

In this case, the tongue should preferably be connected to the mounting, which is also an adapter, by means of a gib and cotter rail clip.

By means of the theory embodied in the invention it is ensured that the tongue can be connected to the junction rail without welding in a simple but safe way, without running the danger of producing in the junction area any shock which would influence riding comfort and lead to wear. Rather, the tongue of such a type is connected to the mounting or the adapter in such a way that a flush connection from the junction rail to the tongue is achieved. This is ensured by the fact that in relation to the junction rail the mounting is installed so that it is immovable and the tongue itself clamped in such a way that it is not possible to move it lengthwise. For this purpose, in addition to the gib and cotter rail clips, additional removable anchor or key can be used.

The detachable arrangement for the tongue makes it possible to replace the tongue without any problem so that damaged or worn tongues can be replaced without difficulties and without requiring extensive work time.

The design of the invention calls for the tongue to have a cotter-shaped flange area which extends within the mounting at least lengthwise and on the outside is adjacent to the cotter element.

The mounting itself should consist of a block which extends to both sides of the junction rail web, with the block having on its upper side a groove-like receptacle for the tongue. Furthermore, the mounting consists of two sections of differing breadths, from which the narrower section runs along the junction rail web and the wide section extends in front of the inclined junction.

In order to ensure a safe and firm connection between the mounting and the junction rail, the junction rail is reinforced by fish plates, for example, which on their part are at least partially welded to the mounting.

If, in the rail head area, the connection between junction rail and tongue is formed as an inclined junction, preferably with an angle of 30 degrees in relation to the flat surface running vertical to the longitudinal axis of the junction rail, then the junction rail web and/or foot should end flush on the tongue side, in which case at least on the front side the junction rail foot should be welded to the mounting.

In order to safely fasten clip elements such as gib and cotter rail clips in the mounting and in order to realize the required closed linkage for the tongue, in the mounting there should be a T-shaped slot, with at least one nut, into which fits one of the screw elements extending from the cotter element.

Further details, advantages and characteristics of the invention can be seen not only from the claims the characteristics of which can be seen individually and/or in combination, but also from the following description of a preferred example shown in the drawings.

Figure 1:
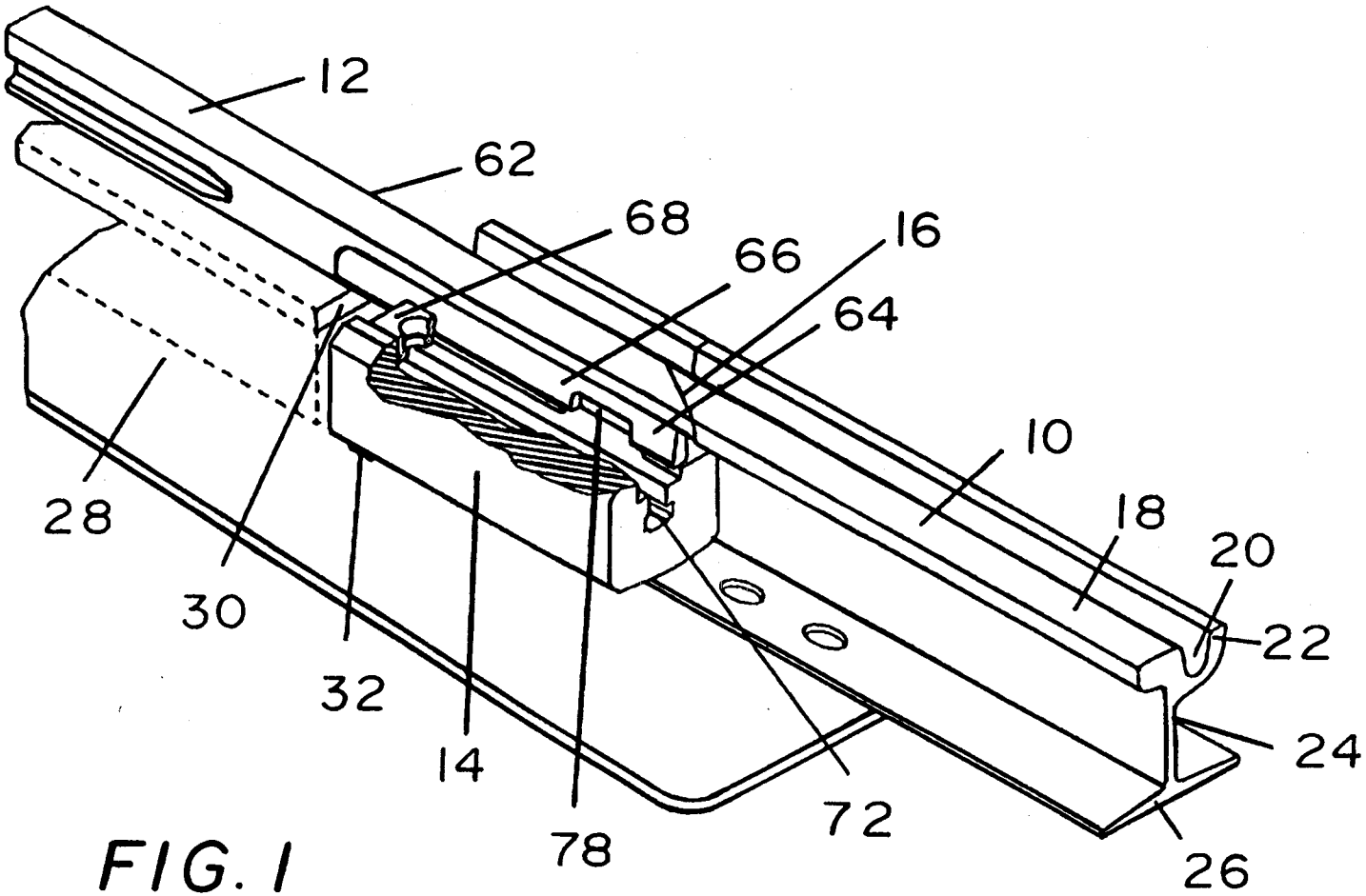
FIG. 1 a perspective representation of a junction rail-tongue junction with a partially broken-away mounting for the tongue, FIG. 2 a section of the junction rail in accordance with FIG. 1, with the mounting connected to it, FIG. 3 a cross-section representation of the mounting according to FIGS. 1 and 2, with the tongue installed in it, and FIG. 4 a perspective representation of the junction rail with mounting extending from it in a view turned 180 degrees opposite that shown in FIG. 2.

The Figures, in which identical elements are given identical reference numbers, show a switch section of a tramway track with junction area between junction rail (10) in the form of a tramway rail and a tongue (12). It is obvious that the theory embodied in the invention also can be realized for standard switches or junctions with other known types of rails, such as, for instance, Vignoles rails.

Deviating from the known level of technology, the tongue (12) is not welded to the junction rail (10). Rather, there is a detachable connection by means of a mounting (14), which can also be called a tongue adapter, which is described in more detail in the following text.

Between the junction rail (10) and the tongue (12) there is an inclined junction (16) of preferably 30 degrees in relation to a flat surface vertically intersecting the longitudinal direction of the junction rail (10).

The junction rail (10) is of standard construction and therefore has a rail head (18) and an edge (22) located slightly above a groove (20), a rail web (24), as well as a rail foot (26). The rail foot (26) is screwed onto a base plate (28). From the base plate (28), by means of a spacing element not described in greater detail, extends a slide plate (30) for the switch tongue (12).

The mounting (14) is attached to the rail foot (26) and/or support plates (32), which in their turn extend from the base plate (28). The fastening for the mounting (14) is selected in such a way that it cannot be moved in relation to the junction rail (10). This ensures that the tongue (12) extending in the following described manner from the mounting (14) is also immovable in relation to the junction rail (10).

Figure 4:
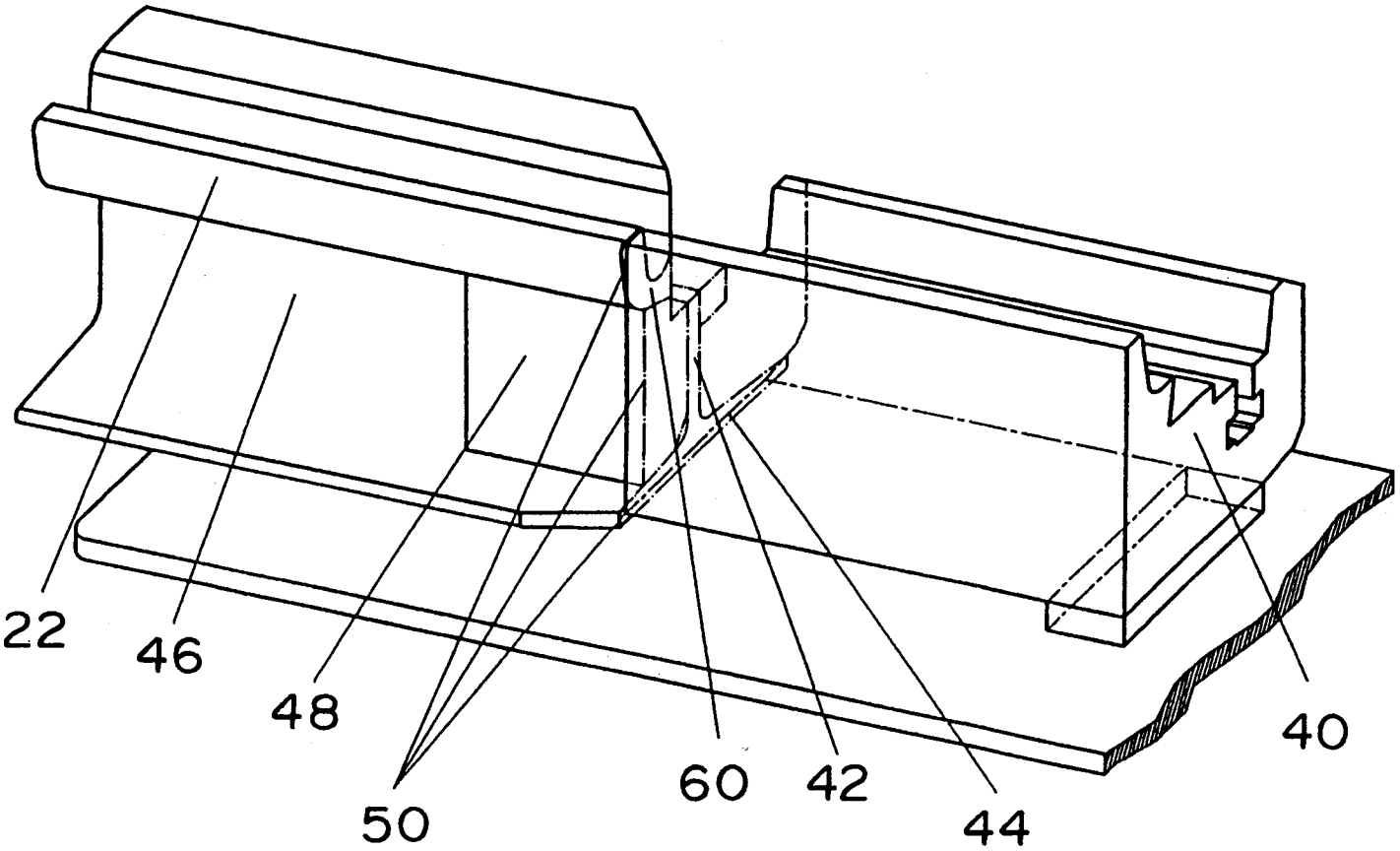

The mounting consists of a block (14) which extends to both sides of the junction rail web (24), with a narrower section (34) running along one of the sides of the web, that is, along the surface (38) under the rail head (18). If need be, reinforcing fish plates (36) can be used. The wider section (40) connecting to the narrow section (34) is adjacent to the front surfaces of the rail web (24) and rail foot (26), which, in the area of the inclined junction (16), end flush with the rail head (18) and tongue (12). In FIG. 4, they are designated by the numbers (42) and (44).

Consequently, between sections (34) and (40) of the mounting (14), a step is produced which is adjacent to the front surfaces (42 and/or 44) of the rail web (24) and the rail foot (26) and to which it can be welded.

It can also be seen in FIG. 4 that not only along the surface (38) of the rail web (24), but also along the opposing surface (46) are reinforcing fish plates (48), whose front surface on its part-like those of the rail web (24) and/or rail foot (26)-is welded to the section (40) of the mounting. This can be seen by reference number (50) in FIG. 4.

The mounting (14) shows a groove-shaped receptacle (52) which, on the side turned toward the surface (38) of the junction rail, has a highly raised edge (54), whose inner surface (56) runs inward obliquely.

On the side turned toward the opposing surface (46) of the rail web (24), the mounting (14) has an edge (58) which matches the geometry of the edge (22) of the junction rail (10) and which is adjacent to and level with the front surface (60) of the edge (22) of the junction rail (10) and is welded to it.

Figure 2:
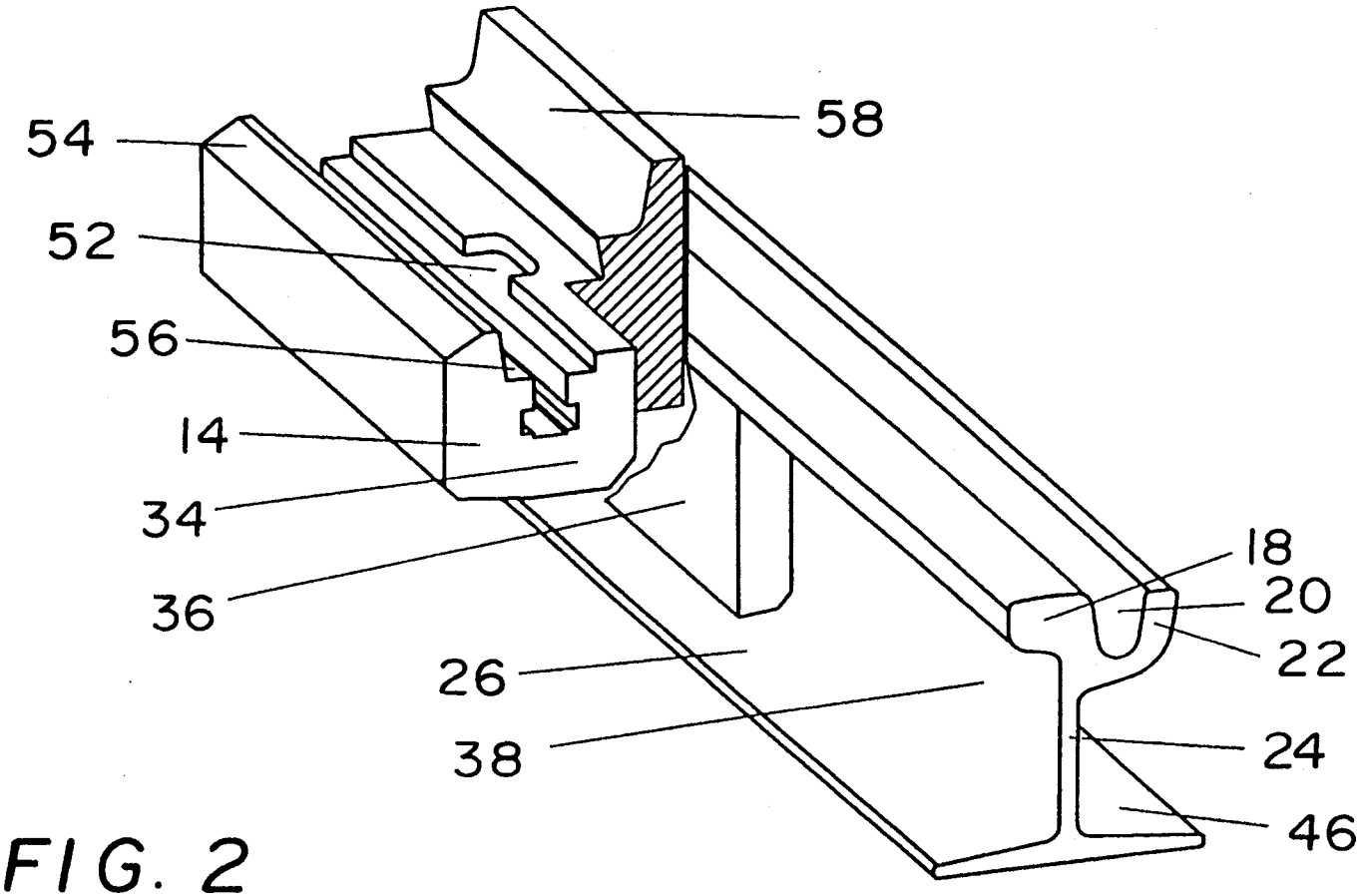
Figure 3:
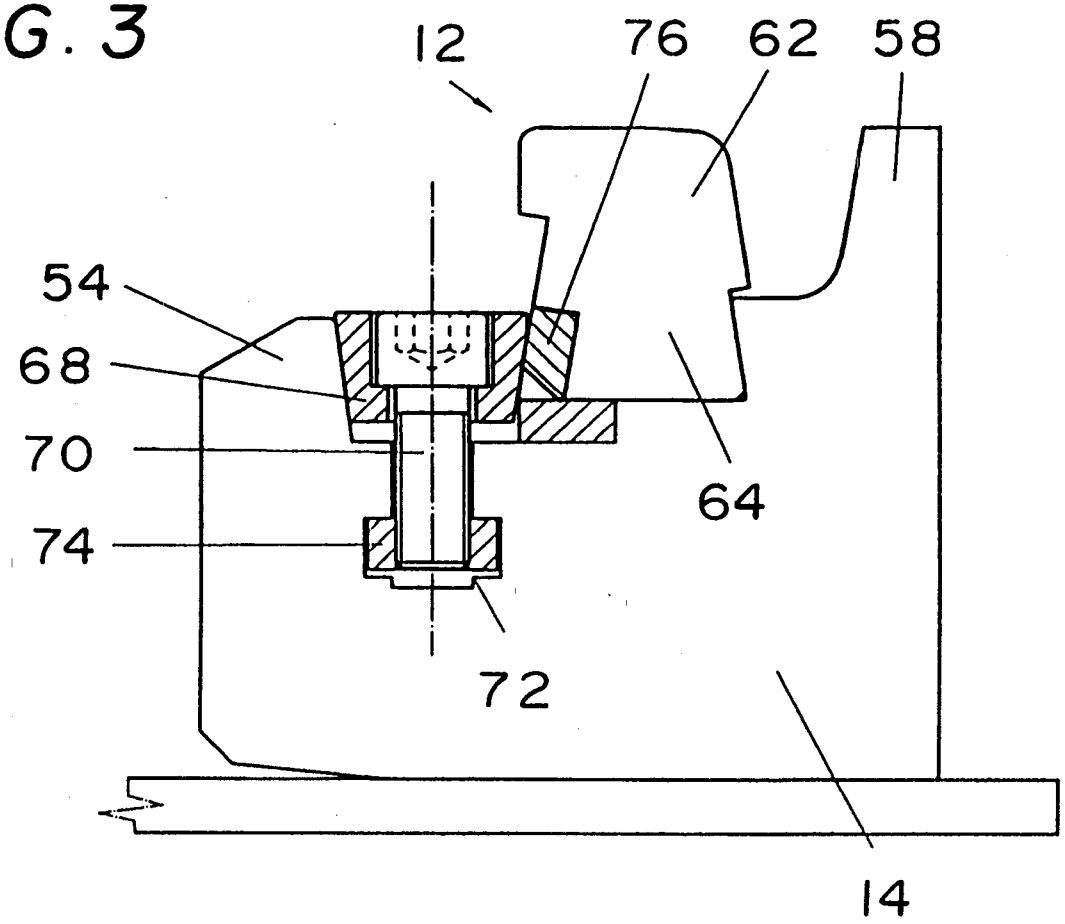

The edge (58) further partially follows the geometry of the groove (20) of the junction rail (10), as made clear by the section representation in FIG. 2.

The tongue (12) is placed in the groove-shaped receptacle (52) in such a way that its head (62) fits flush with the rail head (10). Within the receptacle (52) there further extends a web(64) whose surface (66) facing the outside edge (54) runs in its direction so that the inner areas of contact of the web (64) and the edge (54) run towards one another in a wedge-shaped manner.

To clamp the switch tongue (12), a gib and cotter rail clip is now installed between the web (64) and the edge (54), and then tightened in the direction of the bottom surface of the mounting (14) by means of screws (70). For this purpose, the mounting (14) has a T-shaped slot (72) into which nuts (71) are placed and threaded with the screws (70). Alternatively, it is also possible for threads to be cut into the block.

The mounting described in the invention accepts the switch tongue in such a manner that it can be detached, without giving up any of the advantages of welded junctions between junction rails and tongues. To achieve this, the switch tongue (12) is immovably installed in the mounting (14) by means of a clamping element such as a gib and cotter rail clip. The mounting (14) on its part is permanently installed on the junction rail (10). The mounting (14) is further welded to the reinforcing fish plates (48) on the junction rail (10) and/or the rail web (24).

In order to ensure additionally that the switch tongue (12) does not move in a longitudinal direction, holes or recesses (78) are cut into its web (64) so as to be able to adjust the removable anchors or key (76).

We claim:

1. A railway tongue and rail juncture comprising an elongate tongue and an elongate junction rail, said junction rail having a rail head, a rail web and a rail foot, said tongue and said junction rail each having an end with an end face, said end faces being at an inclination to the longitudinal extent of said tongue and said junction rail respectively, and in free abutting engagement with each other and defining an inclined junction, a mounting connecting said tongue and said junction rail, said mounting being fixed to said junction rail with said mounting extending to opposed sides of said rail web, said mounting having an elongate groove-shaped receptacle defined therein by opposed facing walls and extending longitudinally relative to said junction rail, said tongue, adjacent said abutting ends, having an elongate longitudinally extending end section received within and extending along said groove-shaped receptacle, and releasable wedge means engaged within said groove-shaped receptacle between one of said facing walls and said tongue end section and releasably wedging said tongue end section in said groove-shaped receptacle against the second of said facing walls.

2. The railway juncture of claim 1, wherein said wedge means includes a removable gib and cotter means engaging and fixing said gib to said mounting independently of said tongue and said junction rail.

3. The railway juncture of claim 2, wherein said tongue includes a head and a web section, said tongue web section being within and extending along said groove-shaped receptacle with said tongue head paralleling said tongue web section immediately outward of said groove-shaped receptacle.

4. The railway juncture of claim 3, wherein said tongue web section and said second of said facing walls of said groove-shaped receptacle have aligned adjacent recesses therein, and an anchor received within said recesses and retained by said gib whereby longitudinal shifting of said tongue end section relative to said mounting is precluded.

5. The railway juncture of claim 4, wherein said mounting includes two laterally adjacent sections, a narrower section including said groove-shaped receptacle and extending along a portion of said rail web, and a wider section immediately beyond of said end face of said junction rail.

6. The railway juncture of claim 5, including reinforcement plates on said junction rail web, said reinforcement plates being welded to said mounting.

7. The railway juncture of claim 6, wherein said junction rail web longitudinally abuts against mounting and is welded thereto.

8. The railway juncture of claim 7, including an elongate slot defined in said mounting along and immediately below said groove-shaped receptacle, said slot being of an inverted T-shaped configuration, said cotter means including screw means engaged through said removable gib and extending into said slot, and nut means within said slot receiving and retaining said screw means.

9. The railway juncture of claim 2, including an elongate slot defined in said mounting along and immediately below said groove-shaped receptacle, said slot being of an inverted T-shaped configuration, said cotter means including screw means engaged through said removable gib and extending into said slot, and nut means within said slot receiving and retaining said screw means.

10. The railway juncture of claim 1, wherein said mounting includes two laterally adjacent sections, a narrower section including said groove-shaped receptacle and extending along a portion of said rail web, and a wider section immediately beyond of said end face of said junction rail.

11. The railway juncture of claim 1, wherein said junction rail web longitudinally abuts against mounting and is welded thereto.

* * * * *